United States Patent [19]

Swandiak

[11] 3,970,275

[45] July 20, 1976

[54] DISPLAY RACK HOOK

[75] Inventor: Steve Swandiak, Yonkers, N.Y.

[73] Assignee: Artcraft Wire Goods, Inc., Bronx, N.Y.

[22] Filed: Oct. 10, 1974

[21] Appl. No.: 513,551

[52] U.S. Cl. ..... 248/223; 24/84 C

[51] Int. Cl.[2] ..... A44B 21/00; A47F 7/08

[58] Field of Search ..... 248/223, 220, 301, 217, 248/219, DIG. 3; 24/73 SA, 73 TH, 73 HH, 73 C, 84 C; 211/101, 170, 173, 177

[56] References Cited

UNITED STATES PATENTS

| | | | |
|---|---|---|---|
| 312,105 | 2/1885 | Faivre | 24/73 HH |
| 1,140,940 | 5/1915 | Bales | 248/DIG. 3 |
| 1,831,717 | 11/1931 | Muniente | 24/73 HH |
| 2,246,457 | 6/1941 | Schultz | 248/DIG. 3 |
| 3,145,963 | 8/1964 | Best et al. | 248/223 |
| 3,244,391 | 4/1966 | Brunette | 248/DIG. 3 |
| 3,310,271 | 3/1967 | King | 248/DIG. 3 |

*Primary Examiner*—J. Franklin Foss
*Attorney, Agent, or Firm*—Shenier & O'Connor

[57] ABSTRACT

A display rack hook for retaining a member in assembled relationship with a rack hollow upright member, having a plurality of vertically elongated and vertically spaced slots of a certain width, comprising a body cut from round stock, bent at one end thereof to form an upper downwardly opening hook portion, having a leg adapted to be inserted in a slot to support the body on the lower edge of the slot and bent at the other end to form a lower upwardly opening hook portion, aligned with the upper hook portion and adapted to receive the member to be assembled with the upright. The thus bent body is then stamped to provide flat sides and a cross-sectional dimension which is greater than the slot width to inhibit turning of the upper hook portion leg in the slot. Preferably the upper hook portion is so formed that the body cannot be removed by rotation thereof while resting on the lower edge of the slot. The free legs of the hook portions are spaced by a distance less than the space between the pair of adjacent slots.

3 Claims, 4 Drawing Figures

DISPLAY RACK HOOK

BACKGROUND OF THE INVENTION

There are known in the prior art display racks comprising an assembly of members including hollow uprights having a plurality of vertically elongated and vertical spaced slots formed in a wall thereof. These slotted upright members are adapted to receive various forms of brackets to facilitate the mounting of shelves, hang rods and hang rings and the like on the rack. In particularly, one of the most commonly used type of brackets which is employed to hold a rod in position on the frame uprights is a "barrel clip". More specifically, this clip is stamped from sheet metal and then bent, so as to provide a pair of plate-like fingers adapted to be inserted in a pair of adjacent slots in the upright and having slots in the inner ends of the fingers for receiving wall portions of the upright at the lower edge of the slots. In addition, these members are formed with barrels for receiving the rod.

While the barrel clip of the type described above functions satisfactorily to mount a rod in position on the display rack, it is relatively complicated for the result received thereby. It is moreover expensive to construct.

I have invented a display rack hook which overcomes the disadvantages of devices such as the barrel clip described thereinabove. My display rack hook is adapted securely to hold a number, such as a rod is adapted securely to hold a number, such as a rod in position on a display rack. By use of my hook such a rod can rapidly and expeditiously be applied to the rack. My display hook simpler than are clips of the prior art intended to accomplish the same purpose. My display rack hook is appreciably less expensive to manufacture than are the clips of the prior art for accomplishing the same purpose.

SUMMARY OF THE INVENTION

One object of my invention is to provide a display rack hook for attaching a member such as a rod to a display rack in a simple and expeditious manner.

Another object of my invention is to provide a display rack hook which is simpler than are clips of the prior art intended to achieve the same purpose.

A still further object of my invention is to provide a display rack hook which is appreciably less expensive than are clips of the prior art.

Still another object of my invention is to provide a method of making a display rack hook in a rapid, simple and inexpensive manner.

Other and further objects of my invention will appear from the following description.

In general my invention contemplates the provision of a display rack hook and method of making the same in which a length of round stock is cut to size and then is bent backwardly on itself at each end so as to form an upper downwardly opening hook portion and a lower upwardly opening hook portion, which is generally aligned with the upper hook portion. After bending, the length is stamped, so as to flatten the sides thereof. The free leg of the upper hook portion is so dimensioned so as to inhibit twisting of the hook in the slot.

BRIEF DESCRIPTION OF THE DRAWINGS

In the accompanying drawings which reference is made in the instance specification and in which like parts are indicated by the same reference character in the various figures.

DESCRIPTION OF THE PREFERRED EMBODIMENT

Figure 1:
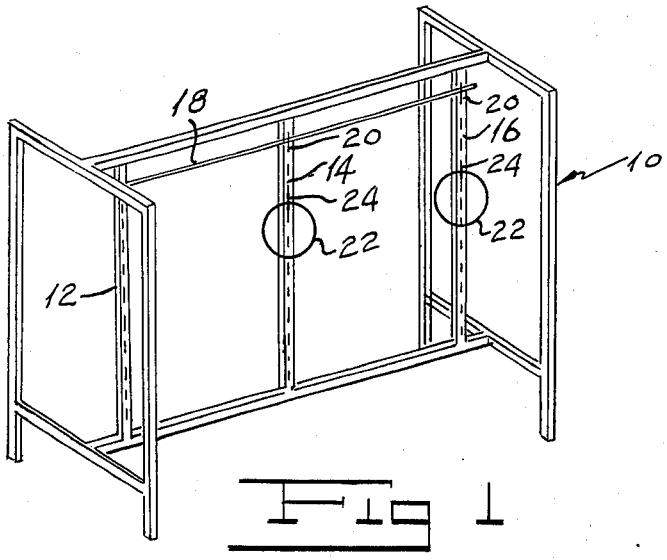
FIG. 1 is perspective view of a rack with which my display hook may be used.

Referring now to the drawings, a rack indicted generally by the reference character 10 with which my display hook may be used, includes a plurality of spaced uprights 12, 14 and 16. Various elements are adapted to be assembled on the frame 10 to provide the desired display. For example, one element which is adapted to be assembled on the uprights is a rod 18, which is held on the uprights by a plurality of my hooks indicated generally by the reference character 20. Alternatively, rings 22 on which articles of merchandise may be placed can be assembled on the uprights 24 by a slightly modified form 24 of my hook.

Figure 2:
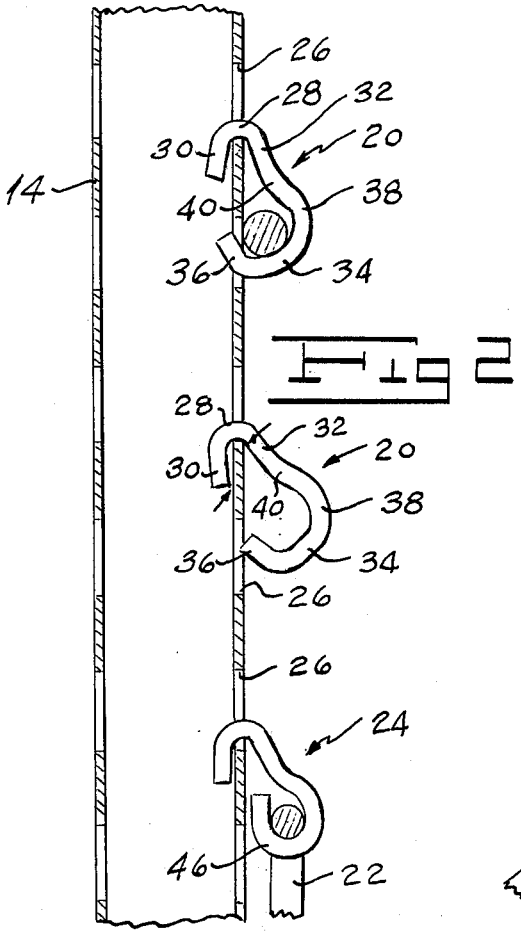
FIG. 2 is a sectional view of one of the uprights of the rack shown in FIG. 1, illustrating the operation of my display rack hook.
Figure 3:
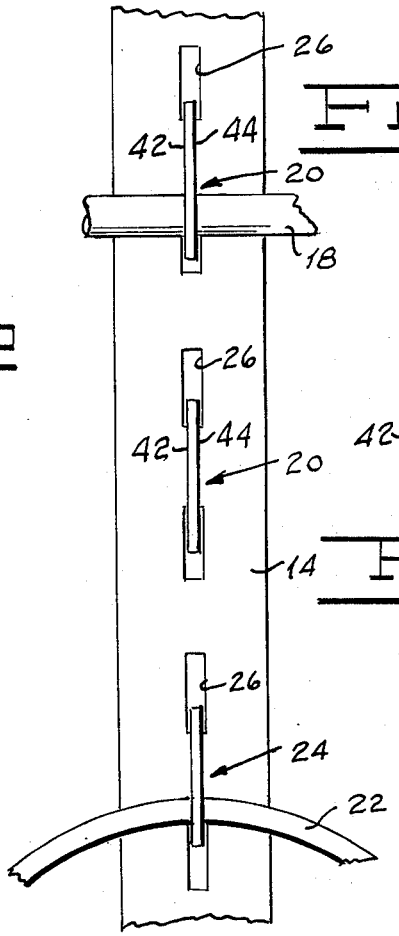
FIG. 3 is a fragmentary front elevation of the upright and hook assembly illustrated in FIG. 2.
Figure 4:
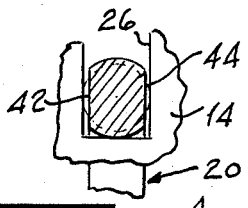
FIG. 4 is a fragmentary sectional view of the portion of the rack upright and of my display hook illustrating one characteristic thereof.

Refering now to FIGS. 2–4, each of the uprights, such for example as the upright 14 is provided with a plurality of vertically elongated and vertically spaced aligned slots 26, adjacent ones of which are adapted to cooperate with my hook 20.

Each of the hooks 20 includes an upper hook portion 28 provided with a pair of spaced legs 30 and 32, forming a downwardly opening hook mouth. Each of the hooks 20 further includes a lower hook portion 34, formed by a pair of spaced legs 36 and 38, forming an upwardly opening hook mouth, which is generally aligned with the mouth formed by the legs 30 and 32. A portion 40 of the body making up the display hook 20 joins the leg 32 of the upper hook portion 28, with the leg 38 of the lower hook portion 34.

In making my display hook 20, I first cut a suitable length from a piece of round bar stock. When that has been done, one end of the length is bent to form the hook portion 28. Next, the other end of the length is bent back on itself in the same direction to form the lower hook portion 34. After these two operations have been performed, the length is stamped in a direction perpendicular to the plain of the two hooks to form a pair of flat sides 42 and 44 on the hook body. This form of my hook is especially adapted to mount a rod, such as the rod 18 on the frame 10. Alternatively, where a ring, such as the ring 22 is to be mounted on the frame 10, the lower leg 36 can be bent inwardly as indicated by 46 in FIG. 2 securely to hold the ring in position.

In use of my hook 20 to hold a bar, such as the bar 18 on the uprights 12, 14 and 16, the leg 30 of the upper hook portion 28 is inserted in a slot 26 in the uprights, such as upright 14, for example, and the rod 18 is placed in position in the lower hook portion. Next, the upper hook portion is permitted to come to rest on the lower edge of the slot 26, which receives the hook portion. In this condition of the parts, the leg 36 will enter into the slot 26, immediately below that slot which receives the leg 30. Owing to the manner in which I form my display hook, in cross-section the hook has a dimension which is greater than the width of a slot 26, so that the hook cannot be twisted in the slot. Moreover, as indicated by the arrows adjacent to the intermediate hook 20 illustrated in FIG. 2 of the drawings, the display hook 20 cannot be completely separated from the upright 14 merely by rotating it on the lower edge of the slot which receives the leg 30. I so space the legs 30 and 32 and make them of such a length as to inhibit this action. It is to be noted further that the distance between the ends of legs 30 and 36 is less than the space between a pair of adjacent slots 26, so that the hook will not be easily become accidentally disengaged from the upright 14.

It will be seen that I have accomplished the objects of my invention. I have provided a display rack hook which overcomes the disadvantages of brackets and and clips of the prior art which are employed for the same purpose. My display rack hook is appreciably less expensive to manufacture than are display rack clips and brackets of the prior art intended to achieve the same purpose. My display rack hooks securely holds a member, such as a rod in position on a display rack upright. It is simple and expeditious to use.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is therefore, to be understood that my invention is not to be limited to the specific details shown and described.

Having thus described my invention, what I claim is:

1. A hook for retaining a member on a display frame having a hollow upright formed with a plurality of vertically elongated and vertically spaced slots of a predetermined width including a unitary body, a first hook portion formed in said body with a downwardly opening mouth defined by a pair of legs, one of which is adapted to be received in one of said upright slots with said first hook portion supported on the lower edge of the slot, said first hook portion of said body being formed with a noncircular uniform cross section throughout its extent from the other leg through said one leg, said cross section having a minor dimension less than said slot width to permit said first hook portion to be inserted in said slot in a vertical orientation of the body and having a major dimension greater than said slot width to prevent twisting of said body around its longitudinal axis when said first hook portion is in said slot, a second hook portion formed in said body with an upwardly opening mouth defined by a pair of legs, and a portion of said body connecting the other leg of the first hook portion to one of the legs of the second portion, said mouths being generally aligned, the end of said one leg of said first hook portion facing the end of the other leg of the second hook portion, the distance between said leg ends being less than the space between adjacent upright slots, the space between the legs of the first hook portion and the lengths of said first hook portion legs being such as to inhibit removal of said hook from said upright by rotation with said first hook portion resting on said slot edge.

2. A hook as in claim 1 in which said unitary body is formed with said noncircular uniform cross section throughout its extent.

3. A hook as in claim 1 in which the other leg of said second hook portion is adapted to enter an upright slot below said one slot.

* * * * *